United States Patent [19]

Gerlach

[11] Patent Number: 4,733,781

[45] Date of Patent: Mar. 29, 1988

[54] STACKING CONTAINER FOR SHAPED PARTS, IN PARTICULAR STAMPED SHEET METAL PARTS

[76] Inventor: Karl Gerlach, Odenwaldstrasse 22, D-6096 Raunheim, Fed. Rep. of Germany

[21] Appl. No.: 865,814

[22] PCT Filed: Sep. 14, 1985

[86] PCT No.: PCT/EP85/00469

§ 371 Date: May 9, 1986

§ 102(e) Date: May 9, 1986

[87] PCT Pub. No.: WO86/02056

PCT Pub. Date: Apr. 10, 1986

[30] Foreign Application Priority Data

Sep. 29, 1984 [DE] Fed. Rep. of Germany ..... 3435941

[51] Int. Cl.[4] ..... A47G 19/08

[52] U.S. Cl. ..... 211/41; 211/4; 211/89; 206/448; 206/454; 410/38; 410/43

[58] Field of Search ..... 211/41, 13, 8, 49.1, 211/59.4, 89, 4; 410/43, 31, 34, 38; 206/454, 448

[56] References Cited

U.S. PATENT DOCUMENTS

| | | | |
|---|---|---|---|
| 2,946,453 | 7/1960 | Pityo | 211/41 |
| 2,953,253 | 9/1960 | Henderson | 211/41 |
| 3,533,502 | 10/1970 | Hansen | 206/1 |
| 3,744,647 | 7/1973 | Jelinek | 410/43 X |
| 4,445,616 | 5/1984 | Mancusi | 211/13 |
| 4,512,473 | 4/1985 | Thomaswick et al. | 206/448 X |

FOREIGN PATENT DOCUMENTS

| | | | |
|---|---|---|---|
| 2234949 | 7/1972 | Fed. Rep. of Germany | 206/454 |
| 3406293 | 9/1985 | Fed. Rep. of Germany . | |

*Primary Examiner*—Ramon S. Britts
*Assistant Examiner*—Blair M. Johnson
*Attorney, Agent, or Firm*—Burns, Doane, Swecker & Mathis

[57] ABSTRACT

A stacking container to receive shaped parts (2), in particular stamped sheet metal parts, consists of a frame stand (3) with upper and lower holding ledges (6, 7) between which the shaped parts (2) are being held in the upright position. The holding edges (6, 7) comprise profile notches (9, 8) for the edges of the shaped parts (2). Adjacent to every upper holding ledge (10) a height adjustable safety ledge (10) is mounted; it also is equipped with profile notches (12). In their lower position the safety ledges (10) are holding the edges of the shaped parts (2) received, when the stacking container is being transported.

8 Claims, 6 Drawing Figures

STACKING CONTAINER FOR SHAPED PARTS, IN PARTICULAR STAMPED SHEET METAL PARTS

BACKGROUND OF INVENTION

Figure 1:
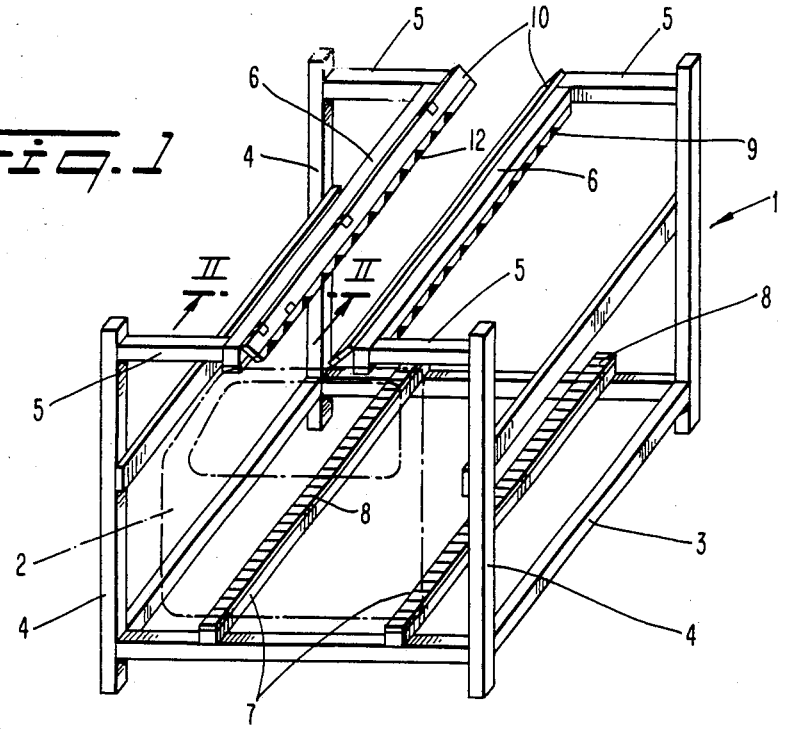

The invention concerns a stacking container for shaped parts, in particular stamped sheet metal parts, consisting of a frame stand with longitudinal upper and lower holding ledges which between them receive the shaped parts and comprise a row of spaced apart profiled notches to hold the upper or lower edges of the shaped part.

Thin walled shaped parts, in particular large stamped sheet metal parts for automotive vehicles must be stacked in stacking containers between production stages and during transportation and intermediate storage prior to further processing. As the surface of such shaped parts is frequently highly sensitive to damage, care must be taken that the parts are being held at a predetermined distance from each other, wherein however, the distances should be as small as possible in order to reduce the storage volume required.

Loading and unloading in the case of known stacking containers is manual. In view of the considerable risk of injuries while handling the mostly sharp edged sheet metal parts and because of the substantial time requirements, which no longer correspond to the cycles of advanced stamping presses, automatic loading and unloading means were developed, whereby stacking containers are loaded and unloaded. It is possible with such installations to deposit the shaped parts at designated locations within a stacking container so that the parts are received and held between upper and lower holding ledges comprising the appropriate profile notches. In a stacking container of the abovementioned generic type according to the unpublished patent application P No. 34 06 293.9 of the present applicant the profile notches of the upper holding ledges are provided on a mobile profile gripping piece capable of being displaced in the upward direction against the force of a spring. These profile gripping pieces, arranged in a row of bores of the holding ledge and resting against a compression spring, are raised upon the introduction of the shaped parts and lowered as soon as the part has assumed its proper position. Unloading takes place in the inverse direction.

As the stacking container is holding the shaped parts not only in intermediate storage but also for transportation, said parts are frequently exposed in transport to considerable impacts. This creates the risk that the parts are accelerated upwards to the extent that they raise the profile gripping pieces against the force of the springs, whereby the shaped pieces may be released from their holders. While it is possible to block all of the mobile gripping pieces in transport, it would involve a considerable expenditure.

It is therefore the object of the invention to provide a stacking container of the abovementioned generic type making possible the secure immobilization of the shaped parts being held in transportation.

This object is attained according to the invention by that at least along one of the upper holding ledges a height adjustable safety ledge is arranged.

This safety ledge is lowered if the stacking container is to be transported together with the shaped parts contained therein. The safety ledge is raised for loading and unloading.

The safety ledge may be adjusted in height for example by that it is mounted on the holding ledge pivotingly around an upper longitudinal pivot axle.

It is further possible to guide the safety ledge so that it may be displaced in height.

The invention renders it possible in a particularly advantageous manner to eliminate the spring supported profile gripping pieces and instead equip the holding ledge in a structurally much simpler manner with sawtooth like profile notches to hold the upper edges of the shaped parts. The individual profile notches of the upper holding ledge must be high enough so that the indivudal shaped parts may be inserted in the raised position and subsequently lowered into the profile notches of the lower holding ledge. The safety ledge, which is also equipped with sawtooth like profile notches, is placed into its lower position prior to transportation and is holding the individual shaped parts without the need for flexible holding by spring supported profile gripping pieces or the like. This results in a significantly simpler configuration of the holding ledges and for their conversion to hold different shaped parts, either the holding ledges themselves or profile ledges fastened to the holding ledges may be replaced rapidly and with little effort.

Preferably, every profile notch of the safety ledge is equipped with an oblique lateral surface and the lateral surface of the associated opposite notches facing the said oblique surface is approximately vertical. It is obtained in this manner that the oblique lateral surface of the profile notches of the safety ledge is pressuring in the course of the lowering of the safety ledge the edge of the shaped part received against the opposite vertical lateral surface of the profile notches of the holding ledge, thereby clamping the edge of the shaped part and preventing its rattling in transport. Surface damage to the shaped parts at the gripping locations is thereby prevented, in particular if the profile notches are entirely or partially lined with an elastic material, for example rubber.

THE DRAWINGS

Further advantageous embodiments of the invention are the objects of dependent claims.

Figure 2:
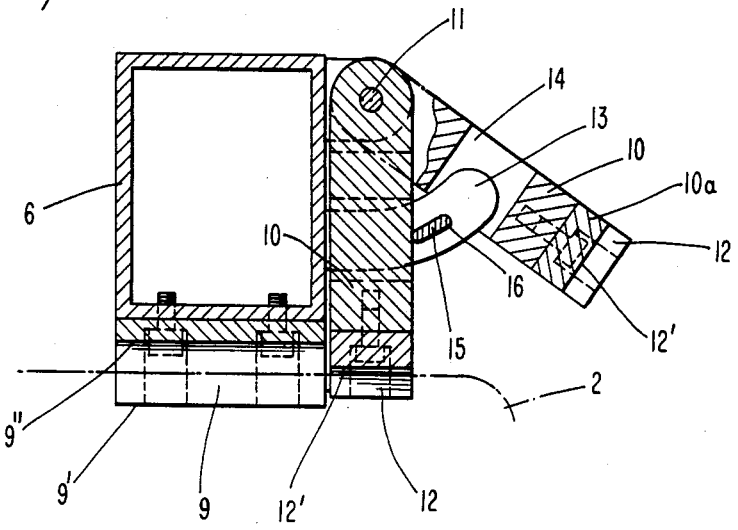
Figure 3:
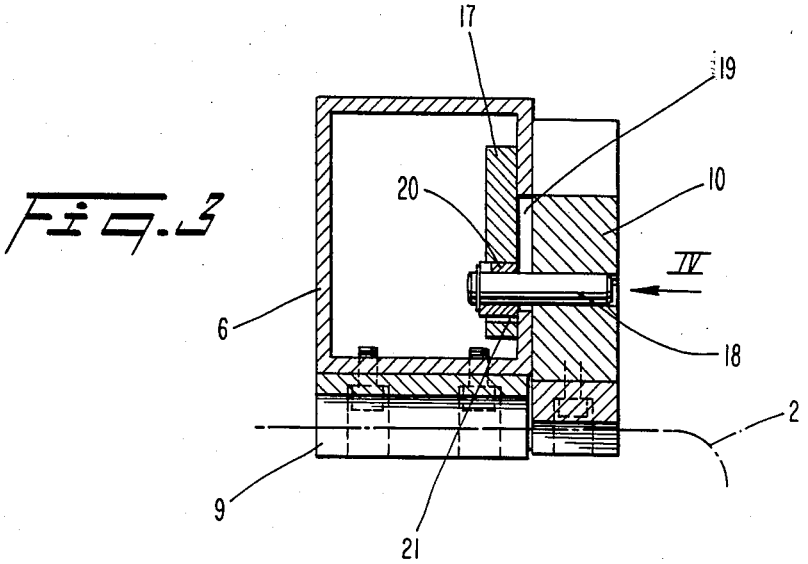
Figure 4:
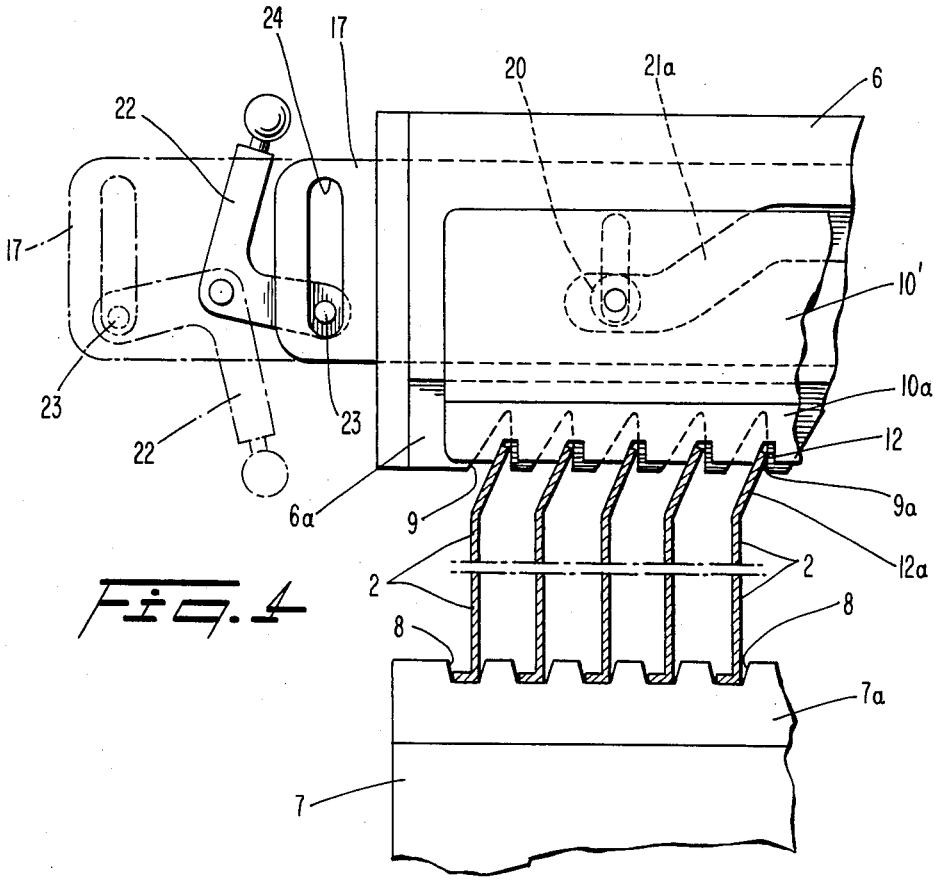
Figure 5:
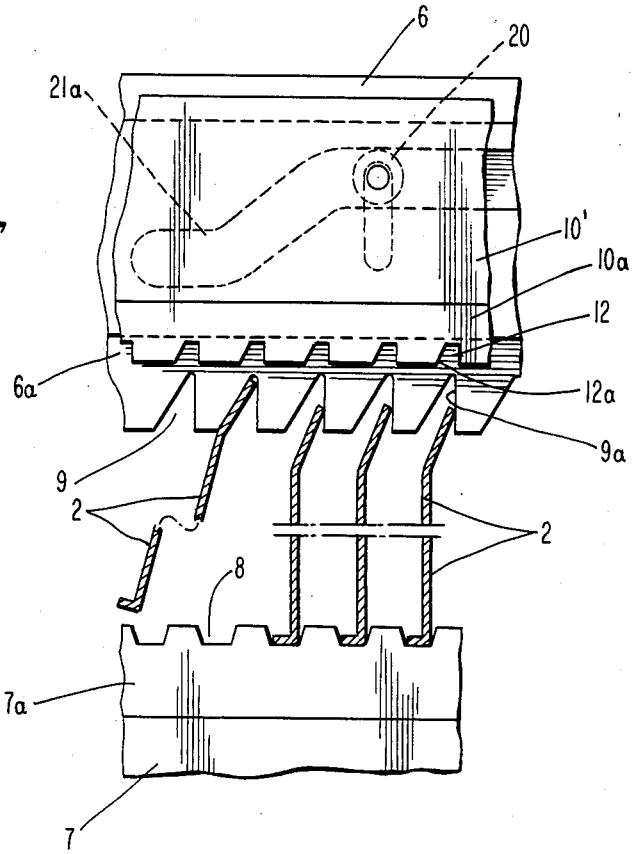

The invention will become some apparent below from the an example of embodiment with reference to the drawing. In the drawing:

FIG. 1 shows in a perspective view a stacking container for shaped parts,

FIG. 2 an enlarged vertical section on the line II—II in FIG. 1,

FIG. 3 a section according to FIG. 2 of a modified from of embodiment,

FIG. 4 a view in the direction of the arrow IV in FIG. 3,

FIG. 5 a view according to FIG. 4 with the safety ledge raised and

Figure 6:
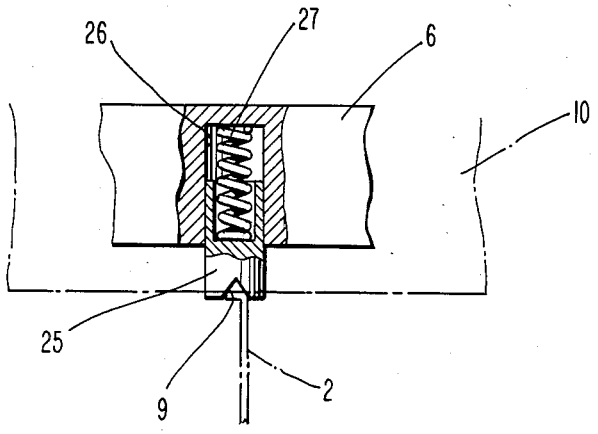

FIG. 6 in a partial section a modified form of embodiment of the holding ledge with spring loaded profile gripping pieces.

The stacking container 1 shown in FIG. 1 is intended for the preferably upright holding of shaped parts, for example doors 2 for automotive vehicles. It has a frame stand 3 with corner posts 4 carrying on inwardly projecting supports 5 two upper holding ledges 6, arranged spaced apart and parallel to each other. In addition, in the frame stand 2, two parallel and spaced apart lower holding ledges 7 are mounted.

For adaptation to different shaped parts 2 the holding ledges 6 and 7 may be mounted replaceably and/or adjustably and the supports 5 and/or the corner posts 4 may also be replaceable or adjustable.

As seen in a particularly clear manner in FIGS. 4 and 5, the lower holding edges 7 comprise a row of spaced apart profile notches 8, wherein the lower edge of a shaped part 2 is being held. In order to facilitate conversion for different parts 2, the profile notches 8 may be provided on a replaceable ledge part 7*a* of the holding ledge 7.

The upper holding ledges 6 are also equipped with profile notches 9 to hold the upper edge of a part 2. In the embodiment according to FIGS. 1 to 5, the profile notches 9 are arranged in a row and spaced apart and are provided similarly to the lower holding ledge 7, i.e., sawtooth like, on a replaceable ledge 6*a*, which may be attached by screws (not shown). The profile notches 9 are high enough so that a shaped part 2 may be raised in a slightly inclined position to the upper end of the profile notches 9 and lowered into the associated lower profile notches 8. This process is clearly seen in FIG. 5.

In the embodiment according to FIGS. 1 and 2, adjacent to every upper holding ledge 6 a safety ledge 10 is arranged; it is mounted pivotingly around an upper longitudinal pivot axle 11 on the holding ledge 6. The safety ledge includes a row of spaced apart, downwardly opening profile notches 12. That row can be screwed onto the ledge 10*a*. It is seen in FIG. 2, that the height of the profile notches 12 is such that each individual shaped part 2 is held in the vertical, clamped down position of the safety ledge 10, in its lower position. Even in the case of vertical impacts the shaped parts 2 cannot be raised to the extent that they leave the lower profile notches 8 or the upper profile notches 9.

That is, the safety ledge 10 includes a stop surface 12', which, when the safety ledge is in a lower position, is disposed higher than a lower edge 9' of the notches 9 and lower than a floor 9'' of those notches 9 in overlying relationship to the shaped part 2. Hence, the shaped part 2 is prevented from rising out of the notches 8 of the lower holding ledge. When the safety ledge is moved to an upper position, the stop surface 12' is raised from its lower position sufficiently to permit the shaped part 2 to be raised out of the notches 8 of the lower holding ledge.

In order to immobilize the pivoting safety ledges 10 both in the clamped down and in the upturned position, different mechanical devices may be used. In the embodiment shown (FIG. 2) flat supports 13 projecting from the lateral surface of the upper holding ledge 6 are provided; they protrude through slots 14 of the safety ledge 10. A wedge 15 may be inserted into a slot 16 of the support 13 to hold and secure the safety ledge 10 either in the clamped down or the upturned psition. Both positions of the safety ledge 10 are shown in FIG. 2.

A modified embodiment is shown in FIGS. 3 to 5. The safety ledge 10' is guided here on the lateral surface of the holding ledge 6 in a height adjustable manner in a vertical plane. For this purpose, a longitudinally displaceable guide strip 17 is arranged and guided inside the hollow holding ledge 6, parallel to the safety ledge 10'. A bolt 18 fastened to the safety ledge 10' projects through a vertical slot 19 into the holding ledge 6 and carries a guide roller 20 in it. The guide strip 17 comprises a guide curve 21 in the form of a slot 21a, into which the guide roller 20 is protruding. Preferably, two guide rollers 20 are provided near the two ends of the safety ledge 10'. Within the range of the guide rollers 20 the guide curve 21 comprises a bent section 21*a*. In case of a longitudinal displacement of the guide ledge 17 therefore the safety ledge 10' is either raised (FIG. 2) or lowered (FIGS. 3 and 4).

The longitudinal displacement of the guide strip 17 is effected for example by means of a pivot lever 22 on the end of the holding ledge 6. A bolt 23 connected with the pivot lever 22 engages a vertical slot 24 at the end of the guide strip 17; in case of a movement of the pivot lever 22 the guide strip 17 is moved from the position indicated in FIG. 4 by solid lines (safety ledge 10' lowered) into the position indicated by dash-and-dot lines (safety ledge 10' raised).

It may be seen in FIGS. 4 and 5 that each profile notch 12 of the safety ledge 10' has an oblique lateral surface 12*a*. The opposite lateral surface 9*a* of the associated profile notches of the holding ledge 6 is approximately vertical. In this manner, the upper edge of each shaped part 2 is pressured during the lowering of the safety ledge 10' by the oblique lateral surface 12*a* against the vertical lateral surface 9*a* of the holding ledge 6 and thereby immobilized (FIG. 4). During the transportation of the stacking container 1 filled with shaped parts 2, unintended movements of the shaped parts 2 are prevented so that surface damage to the shaped parts is avoided. In order to receive the edges of the shaped parts in a particularly gentle manner, the profile notches 8, 9 and 12 may be lined entirely or in part with an elastic material or rubber inserts. For example, all of the ledges 6*a*, 7*a* and/or 10*a* may also be made of a suitable soft material.

FIG. 6 shows that the upper edges of the shaped parts 2 may be secured by a height adjustable safety ledge 10 (indicated by dash-and-dot lines) wherein the profile notches 9 receiving the upper edges of the parts 2 are provided on profile gripping pieces 25 which are yieldably supported in bores 26 of the holding ledge 6 by compression springs 27.

I claim:

1. A stacking container for shaped parts such as stamped sheet metal parts, comprising:

a frame including vertically spaced upper and lower holding ledges, each ledge containing a row of spaced apart profile notches for receiving upper and lower edges of shaped parts, and a safety ledge disposed adjacent to and along said upper ledge and including a stop surface, said safety ledge being pivotably mounted about a horizontal axis extending parallel to said upper holding ledge for vertical movement between a lower position in which said stop surface is disposed higher than a lower edge of said notches of said upper holding ledge and lower than a floor of said notches of said upper ledge in overlying relation to a portion of a shaped part to prevent such shaped part from rising out of said notches of said lower holding ledge, and an upper position wherein said stop surface is raised from said lower position sufficiently to permit such shaped part to be raised out of said notches of said lower holding ledge.

2. A stacking container according to claim 1, wherein said safety ledge is vertically movable within a vertical plane.

3. A stacking container according to claim 2 including a guide strip carried by said upper holding ledge and including a vertically curved guide slot, said safety ledge including a guide roller movably disposed in said guide slot to cause said safety ledge to move up and down in response to being horizontally displaced.

4. A stacking container according to claim 1, wherein said safety ledge includes notches, said stop surface being defined by a floor of each said last-named notched.

5. A stacking container according to claim 4, wherein each said notch of said safety ledge includes a surface extending obliquely relative to vertical, and each said notch of said upper holding ledge includes a surface extending vertically, said safety ledge arranged in its lower position to retain each shaped part between a said oblique surface of said safety ledge and a said vertical surface of said holding ledge.

6. A stacking container according to claim 5, wherein said notches of said safety ledge and said upper holding ledge are lined with as elastic material.

7. A stacking container for shaped parts such as stamped sheet metal parts, comprising:

a frame including vertically spaced upper and lower holding ledges, each ledge containing a row of spaced apart profile notches for receiving upper and lower edges of shaped parts, a safety ledge disposed adjacent to and along said upper ledge and including a stop surface, said safety ledge being mounted for vertical movement in a vertical plane between;

a lower position in which said stop surface is disposed higher than a lower edge of said notches of said upper holding ledge and lower than a floor of said notches of said upper ledge in overlying relation to a portion of a shaped part to prevent such shaped part from rising out of said notches of said lower holding ledge, and an upper position wherein said stop surface is raised from said lower position sufficiently to permit such shaped part to be raised out of said notches of said lower holding ledge, and a guide strip carried by said upper holding ledge and including a vertically curved guide slot, said safety ledge including a guide roller movably disposed in said guide slot to cause said safety ledge to move up and down in response to being horizontally displaced.

8. A stacking container for shaped parts such as stamped sheet metal parts, comprising:

a frame including vertically spaced upper and lower holding ledges, each ledge containing a row of spaced apart profile notches for receiving upper and lower edges of shaped parts, and a safety ledge disposed adjacent to and along said upper ledge and including a plurality of notches, each notch including a floor defining a stop surface, said safety ledge being mounted for vertical movement between a lower position in which said stop surface is disposed higher than a lower edge of said notches of said upper holding ledge and lower than a floor of said notches of said upper ledge in overlying relation to a portion of a shaped part to prevent such shaped part from rising out of said notches of said lower holding ledge, and an upper position wherein said stop surface is raised from said lower position sufficiently to permit such shaped part to be raised out of said notches of said lower holding ledge.

* * * * *